US011053677B2

(12) United States Patent
Huang et al.

(10) Patent No.: US 11,053,677 B2
(45) Date of Patent: Jul. 6, 2021

(54) GAS-BEARING MULTI-LAYER MEMBRANE BUILDING STRUCTURE

(71) Applicant: SHENZHEN KELENG COMMERCIAL EQUIPMENT CO., LTD, Shenzhen (CN)

(72) Inventors: Junwei Huang, Shenzhen (CN); Changliang Zhou, Shenzhen (CN); Sizhen Liu, Shenzhen (CN)

(73) Assignee: SHENZHEN KELENG COMMERCIAL EQUIPMENT CO., LTD., Shenzhen (CN)

( * ) Notice: Subject to any disclaimer, the term of this patent is extended or adjusted under 35 U.S.C. 154(b) by 0 days.

(21) Appl. No.: 16/498,116

(22) PCT Filed: Jun. 12, 2018

(86) PCT No.: PCT/CN2018/090832

§ 371 (c)(1),
(2) Date: Sep. 26, 2019

(87) PCT Pub. No.: WO2019/024606

PCT Pub. Date: Feb. 7, 2019

(65) Prior Publication Data

US 2021/0102373 A1 Apr. 8, 2021

(30) Foreign Application Priority Data

Aug. 4, 2017 (CN) ..... 201710661402.X

(51) Int. Cl.
*E04B 1/80* (2006.01)
*E04B 1/76* (2006.01)
*E04B 1/34* (2006.01)

(52) U.S. Cl.
CPC ..... *E04B 1/80* (2013.01); *E04B 1/762* (2013.01); *E04B 1/34* (2013.01)

(58) Field of Classification Search
None
See application file for complete search history.

(56) References Cited

U.S. PATENT DOCUMENTS 5,918,438 A * 7/1999 South ..... E04B 1/169 264/32
8,297,282 B2 * 10/2012 Holley ..... A61G 10/026 128/205.26

(Continued)

FOREIGN PATENT DOCUMENTS

CN 201507032 U 6/2010
CN 203821946 U 9/2014

(Continued)

OTHER PUBLICATIONS

International Search Report of PCT/CN2018/090832.
Written Opinion of PCT/CN2018/090832.

*Primary Examiner* — Joshua K Ihezie
(74) *Attorney, Agent, or Firm* — Dragon Sun Law Firm, PC; Jinggao Li, Esq.

(57) ABSTRACT

The present disclosure discloses an air-borne multilayer film building structure which includes an independent film, a heat-insulation structure covering the independent film, and an airbag cover covering or an outer film cover covering the heat-insulation structure. The heat-insulation structure is installed on the outer wall of the independent film and includes at least two heat-insulation layers sequentially from inside to outside. Each heat-insulation layer is formed by paving a plurality of heat-insulation panels, the heat-insulation panels in every two adjacent heat-insulation layers being installed in a staggered manner. The outer heat-insulation layer covers a seam of the inner heat-insulation layer thereof. The air-borne multilayer film building struc- (Continued)

ture has the advantages of good heat-insulation property, good airtightness, convenience in construction and the like.

9 Claims, 3 Drawing Sheets

(56) References Cited

U.S. PATENT DOCUMENTS

| | | | | |
|---|---|---|---|---|
| 8,668,974 | B2 * | 3/2014 | Purdy | E04C 2/328 428/36.4 |
| 10,400,462 | B2 * | 9/2019 | South, Jr. | E04B 1/166 |
| 2009/0217930 | A1 * | 9/2009 | Holley | A61G 10/026 128/205.26 |
| 2010/0040817 | A1 * | 2/2010 | Purdy | B32B 5/04 428/36.4 |
| 2017/0321438 | A1 * | 11/2017 | South, Jr. | E04B 1/169 |
| 2018/0347174 | A1 * | 12/2018 | Ming | E04B 1/3205 |
| 2020/0011557 | A1 * | 1/2020 | Thomas, Sr. | E04B 1/3211 |

FOREIGN PATENT DOCUMENTS

| | | | |
|---|---|---|---|
| CN | 204311565 | U | 5/2015 |
| CN | 206233440 | U | 6/2017 |
| JP | 2000303719 | A | 10/2000 |

* cited by examiner

GAS-BEARING MULTI-LAYER MEMBRANE BUILDING STRUCTURE

CROSS-REFERENCE TO RELATED PATENT APPLICATION

This application is a national stage application of PCT Application No. PCT/CN2018/090832. This application claims priority from PCT Application No. PCT/CN2018/090832, filed Jun. 12, 2018, and CN Application No. 201710661402.x, filed Aug. 4, 2017, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

TECHNICAL FIELD

The present disclosure relates to the technical field of air film building structures, and in particular relates to an air-borne multilayer film building structure.

BACKGROUND

An air-borne film building refers to a building structure system that uses a special building film as an outer shell, is equipped with a set of intelligent electromechanical equipment to provide a positive pressure inside an air-borne building, and support a main body of the building, and is applied with its advantages of low cost, quick installation, large internal space and the like.

A variety of air-borne film buildings have appeared in the prior art, such as a utility model patent with the publication number of CN206360088U, which discloses an airbag-type building structure, comprising an airbag, a ground heat-insulation layer and an air inlet and outlet mechanism, wherein a layer of heat-insulation panel is arranged on the inner wall of the airbag, and a cover plate is arranged on the outer side of the heat-insulation panel. In this building structure, a heat-insulation panel is installed on the inner wall of the airbag. Although a better heat-insulation effect is achieved, there is a certain safety risk in high-altitude operation due to a large indoor height after the airbag is inflated and raises. A worker needs to fix the heat-insulation panels with his/her head looking upwards during the construction process, resulting in difficulty to operate. In addition, the construction requirements for fixation of the heat-insulation panels are very high, otherwise it is difficult to form a continuous and seamless coverage surface. After the airbag building is used for a long time, the heat-insulation panels may fall down and hurt people or equipment.

Therefore, how to design an air-borne film building structure with good heat insulation effect and convenience in construction is a technical problem to be solved in the industry.

SUMMARY

In order to solve the above defects existing in the prior art, the present disclosure provides an air-borne multilayer film building structure.

In an embodiment of the present disclosure, an air-borne multilayer film building structure comprises an independent film, a heat-insulation structure covering the independent film, and an airbag cover covering the heat-insulation structure, wherein the airbag cover is formed by splicing a plurality of sub-airbags; each sub-airbag comprises an inner layer film facing the independent film and a surface layer film arranged on the outer side of the inner layer film at intervals; two ends of each of the inner layer film and the surface layer film are fixedly welded, wherein the heat-insulation structure is installed on the outer wall of the independent film.

In a further embodiment of the present disclosure, the air-borne multilayer film building structure comprises an independent film, a heat-insulation structure covering the independent film, and an outer film cover covering the heat-insulation structure, wherein the heat-insulation structure is installed on the outer wall of the independent film.

The heat-insulation structure comprises at least two heat-insulation layers sequentially from inside to outside; each heat-insulation layer is formed by paving a plurality of heat-insulation panels, the heat-insulation panels in every two adjacent heat-insulation layers being installed in a staggered manner; the outer heat-insulation layer covers a seam of the inner heat-insulation layer thereof.

The outer heat-insulation layer of the adjacent two heat-insulation layers is fixed on the inner heat-insulation layer thereof, and the innermost heat-insulation layer is fixed on the outer wall of the independent film.

Preferably, the heat-insulation structure further comprises a plastic film, wherein the innermost heat-insulation layer is attached to the plastic film.

The center line of the heat-insulation structure is aligned with the center line of the independent film; an installing area is formed in the center of the heat-insulation structure and faces one surface of the independent film; the installing area is fixedly connected with the center of the independent film.

Extension parts are arranged on the edges of the surface layer film of each sub-airbag, and the extension parts between every two adjacent airbags are spliced and fixed respectively. The fixing manner may be welding by a heat-sealing machine or may be splicing and fixing by a connector.

In an embodiment, the connector is a pair of splints and screws passing through the pair of splints; the extension parts on the edges of the surface layer film of each sub-airbag are stacked vertically and then sandwiched between the pair of splints, and then fixed by passing the screws through the splints.

Preferably, the surface of the independent film, which faces the heat-insulation structure is a continuous smooth surface.

Preferably, a fixing net covers the airbag cover, and the lower end of the fixing net is fixed on the ground.

The lower ends of the airbag cover and the independent film are fixed on the ground; an inflation manifold and an exhaust manifold are connected to the airbag cover; airbag inflation equipment is connected to the inflation manifold; each sub-airbag is equipped with an inflation branch pipe and an exhaust branch pipe, wherein each inflation branch pipe is connected to the inflation manifold; an inflation check valve is arranged on each inflation branch pipe; the exhaust branch pipe is connected to the exhaust manifold; an exhaust electromagnetic valve is arranged on each exhaust branch pipe.

Independent film inflation equipment is connected to the independent film blows air to the independent film through at least one inflation pipe that extends into the independent film.

Compared with the prior art, the air-borne multilayer film building structure has the following advantages:

1. the heat-insulation structure is arranged between the independent film and the airbag, which is convenient for installation construction and operation of the heat-insulation structure; the surface of the independent film is a complete, continuous smooth surface, such that the sanitation degree is improved, and operations such as laser show may be performed on the surface of the independent film conveniently;

2. the heat-insulation structure consists of a plurality of heat-insulation layers, and the outer heat-insulation layer covers the seam of the inner heat-insulation layer thereof, such that the heat-insulation effect of the air-borne multilayer film building structure can be effectively improved; the air-borne multilayer film building has low energy consumption and greatly expands its commercial uses, such as the construction of ice rinks, snow fields, cold storage, controlled atmosphere storage, and heat-insulation houses in cold areas;

3. the midline portion of the heat-insulation structure is fixed on the independent film, and after the independent film is inflated, the other parts of the heat-insulation structure slide automatically along a curved surface of the independent film until they are completely attached to the independent film, such that the building is compact in structure and simple in construction process;

4. the airbag cover is formed by splicing a plurality of sub-airbags, the extension parts on the edges of two sides of each surface layer film of each sub-airbag facilitate the connection of the airbag, and after every two adjacent sub-airbags are connected, they are covered with a waterproof adhesive cloth to prevent external rain and snow from entering the interior of the air-borne multilayer film building;

5. the airbag consists of a plurality of sub-airbags having independent cavities which are parallel to each other, and the inner layer film of each sub-airbag is slightly longer than the corresponding surface layer film thereon, and both ends of each of the inner layer film and the surface layer film are firmly welded;

6. the airbag cover presses the heat-insulation structure inwardly under the constraint of the fixing net, and the heat-insulation structure completely covers and is pressed on the independent film; and 7. the air-borne multilayer film building structure consists of the independent film, the heat-insulation structure, and the airbag cover or the outer film cover, and there are three layers of complete film cloth totally, such that the air tightness is better. Therefore, the air-borne multilayer film building structure meets the applications having high air tightness requirements, such as an air-conditioned cold storage and a high-altitude activity room that needs to be filled with oxygen.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

The present disclosure will be described in detail below with reference to the embodiments and the accompanying drawings, in which.

DETAILED DESCRIPTION

Figure 1:
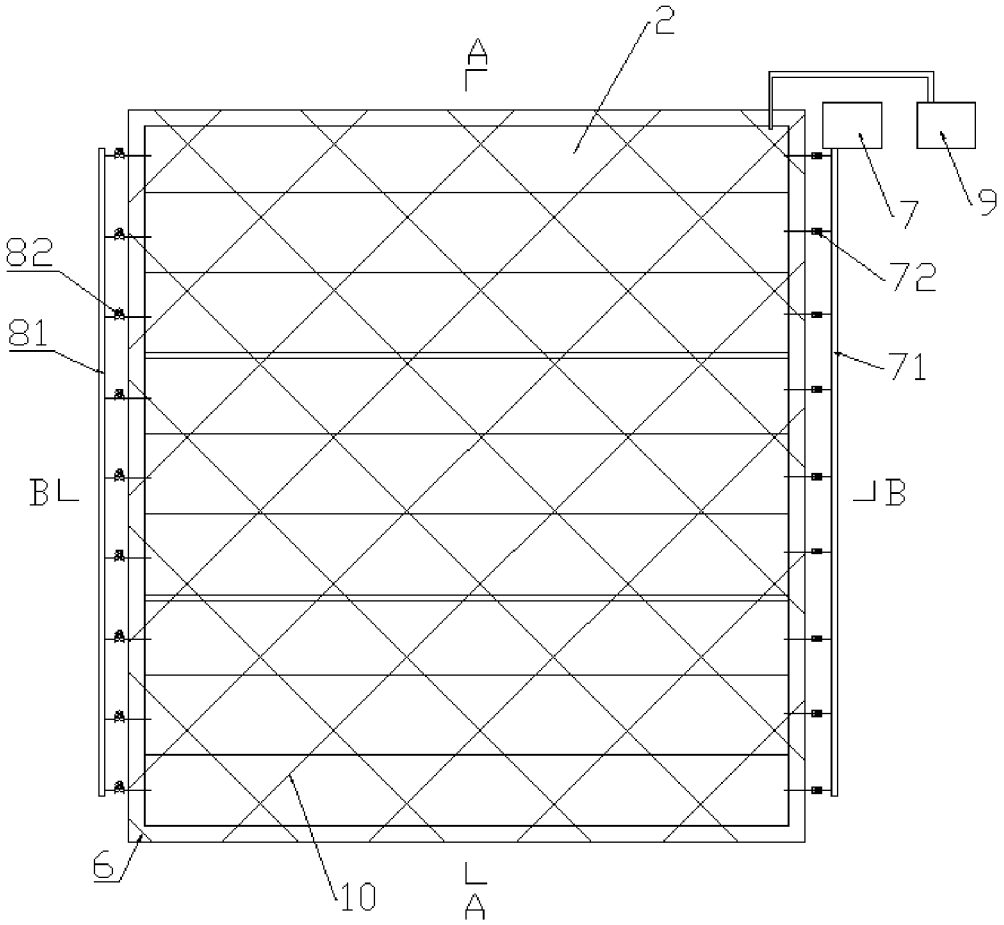
FIG. 1 is a top plan view showing the air-borne multilayer film building structure of the present disclosure.
Figure 2:
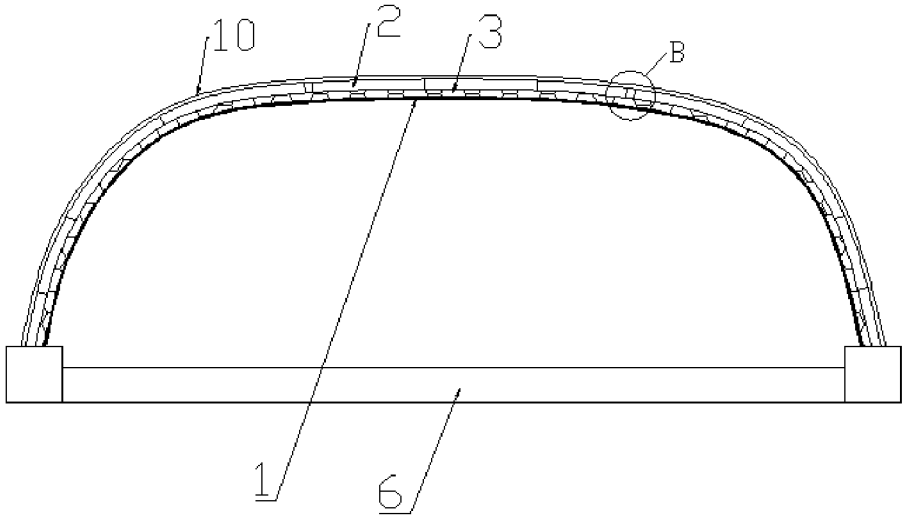
FIG. 2 is a schematic cross-sectional view of A-A in FIG. 1.

As shown in FIGS. 1 and 2, an air-borne multilayer film building structure provided by the present disclosure includes an independent film 1, an airbag cover 2, and an insulation structure 3 arranged between the independent film 1 and the airbag cover 2. The heat-insulation structure 3 covers the independent film. The airbag cover 2 covers the outside of the heat-insulation structure 3.

As an alternative embodiment, the airbag cover 2 may be replaced with an outer film cover. The outer film cover is a continuous smooth film.

Figure 3:
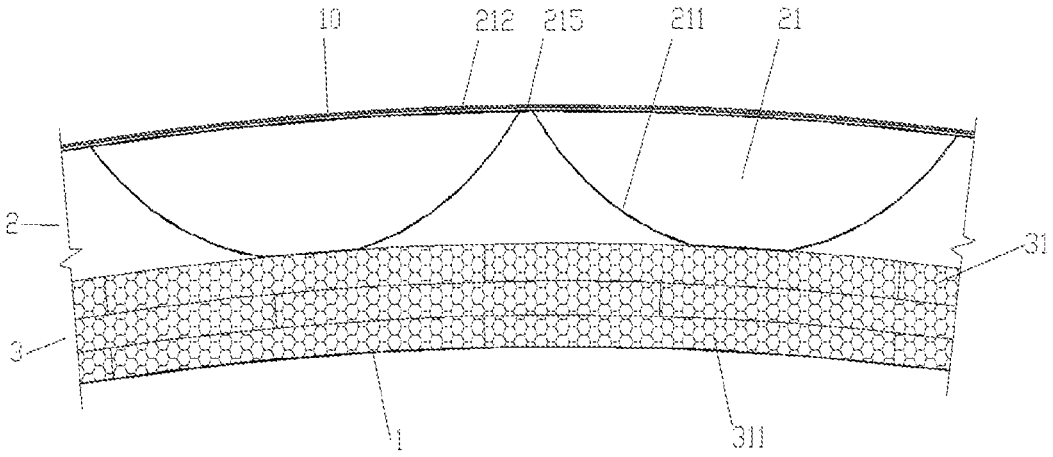
FIG. 3 is an enlarged schematic view showing the splicing by use of a heat-sealing machine at B in FIG. 2.

As shown in FIG. 3, the heat-insulation structure 3 includes at least two heat-insulation layers 31 which are arranged sequentially from inside to outside, wherein each heat-insulation layer 31 is formed by paving a plurality of heat-insulation panels 311. Each heat-insulation layer 31 is made of rubber-plastic heat-insulation cotton or similar flexible heat-insulation materials. The heat-insulation panels 311 in every two adjacent heat-insulation layers 31 are installed in a staggering manner, and the outer heat-insulation layer covers a seam of the inner heat-insulation layer thereof.

The surface of the independent film 1, which faces the heat-insulation structure, is a continuous smooth surface, which is convenient for the installation of the heat-insulation structure.

The heat-insulation structure may further comprise a plastic film, wherein the innermost heat-insulation layer is attached to the plastic film. The heat-insulation structure may be first installed on the plastic film paved on the ground and then installed on the independent film.

Figure 4:
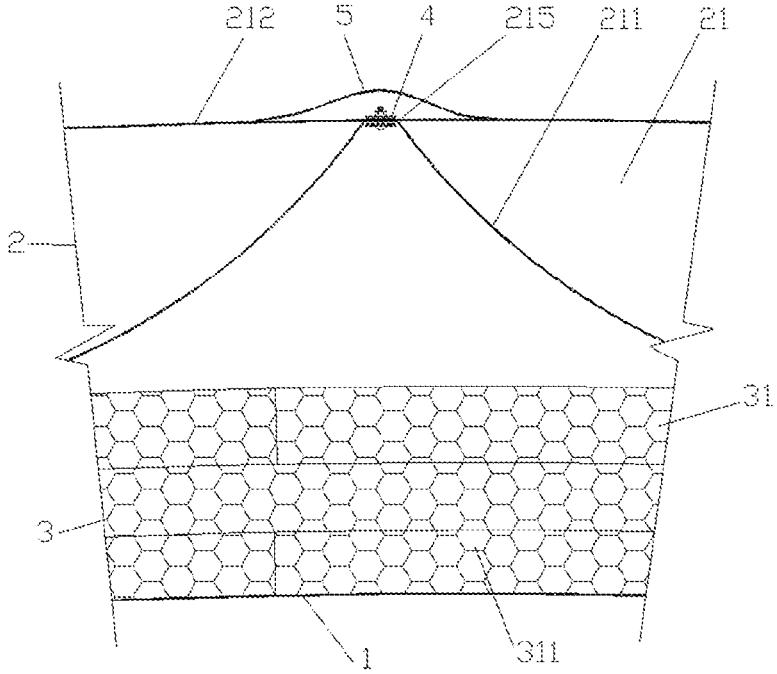
FIG. 4. is an enlarged schematic view showing the splicing by use of a connector at B in FIG. 2.

As shown in FIGS. 2, 3 and 4, the airbag cover 2 is formed by splicing a plurality of sub-airbags 21. Each sub-airbag 21 comprises an inner layer film 211 and a surface layer film 212, wherein the inner layer film 211 faces the independent film 1, and the surface layer film 212 is arranged on the outer side of the inner layer film 211 at intervals. An extension part 215 is respectively arranged on the edges of two sides of each surface layer film 212, and the extension parts 215 may be connected together by use of a mechanical method or welded together by a heat sealing machine. In this embodiment, each sub-airbag 21 includes a plurality of independent cavities which are parallel to each other. The inner layer film 211 of each sub-airbag is slightly longer than the corresponding surface layer film 212 thereon, and both ends of each of the inner layer film 211 and the surface layer film 212 are firmly welded.

As shown in FIG. 3, the extension parts 215 on the edges of each surface layer film 212 are welded together by using the heat sealing machine.

In an embodiment as shown in FIG. 4, the extension parts 215 on the edges of the surface layer film 212 of each sub-airbag 21 are spliced and fixed respectively by a connector 4. The connector 4 is a pair of splints and screws passing through the pair of splints. Two extension parts 215 are stacked vertically and then sandwiched between the pair of splints, and then fixed by passing the screws through the splints. It is also possible to cover the outside of the splicing between the adjacent two sub-airbags 21 with a waterproof adhesive cloth 5. The waterproof adhesive cloth 5 can beautify the appearance of the airbag cover 2, and at the same time, play a certain sealing role on the overlapping portion.

During installation, the heat-insulation structure is spliced on the ground. The center line of the heat-insulation structure is aligned with the center line of the independent film. An installing area is formed in the center of the heat-insulation structure and faces one surface of the independent film. The installing area is fixedly connected with the center of the independent film.

Figure 5:
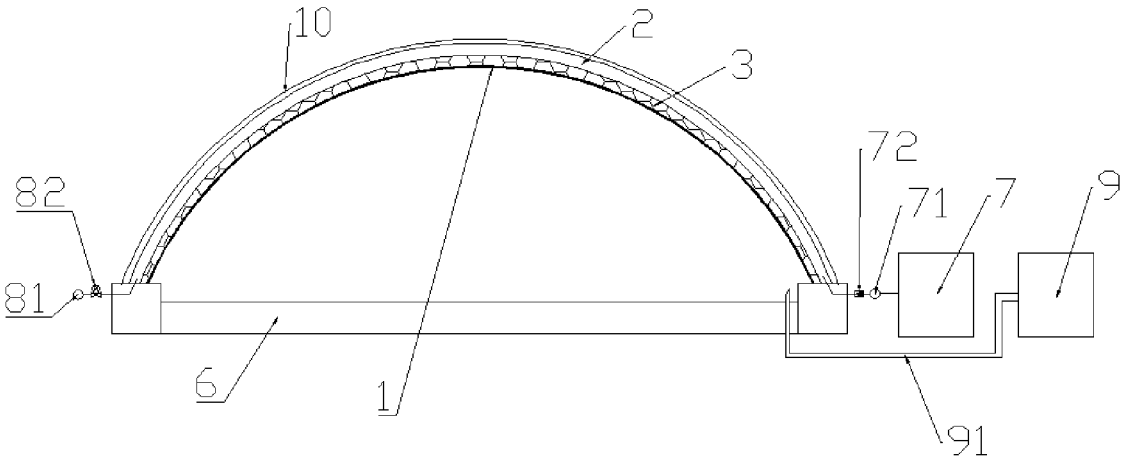
FIG. 5. is a schematic cross-sectional view of B-B in FIG. 1.

As shown in FIGS. 1 and 5, in the construction process of the airbag building, the lower end of the airbag cover 2 is fixed on the ground 6. An inflation manifold 71 and an exhaust manifold 81 are connected to the airbag cover 2. Airbag inflation equipment 7 is connected to the inflation manifold 71. Each sub-airbag is equipped with an inflation branch pipe and an exhaust branch pipe, wherein each inflation branch pipe is connected to the inflation manifold 71, and the exhaust branch pipe is connected to the exhaust manifold 81. An inflation check valve 72 is arranged on each inflation branch pipe, and an exhaust electromagnetic valve 82 is arranged on each exhaust branch pipe. A gas charged in the airbag 21 may be a normal temperature gas or a low temperature exhaust gas from a room. Further, a fixing net 10 covers the airbag cover 2, and the lower end of the fixing net 10 is fixed on the ground 6. The fixing net 10 can effectively limit the expansion shape and height of the airbag cover 2, and improve the stability of the air-borne multilayer film building.

The lower ends of the airbag cover 2 and the independent film 1 are fixed on the ground 6. Independent film inflation equipment 9 is connected to the independent film 1 and blows air to the independent film 1 through at least one inflation pipe 91 that extends into the independent film. The independent film inflation equipment 9 may be equipment such as a blower. The inflation equipment blows air to the independent film and the airbag 21. The airbag 21 presses the heat-insulation structure 3 inwardly under the action of the fixing net, such that the heat-insulation structure completely covers and is pressed on the independent film 1. In addition to acting as an air heat-insulation layer, the airbag cover 2 also functions as a flexible pressure plate after being inflated, and completely covers and presses the underlying heat-insulation structure 3, the pressures being equal everywhere.

The above contents are only the preferred embodiments of the present disclosure, and are not intended to limit the present disclosure. Any modifications, equivalents, and improvements made within the spirit and scope of the present disclosure should be included in the protection scope of the present disclosure.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An air-borne multilayer film building structure, comprising an independent film, a heat-insulation structure covering the independent film, and an outer film cover covering the heat-insulation structure, wherein the heat-insulation structure is installed on a outer wall of the independent film, wherein the heat-insulation structure comprises at least two heat-insulation layers sequentially from inside to outside; each heat-insulation layer is formed by paving a plurality of heat-insulation panels, the heat-insulation panels in every two adjacent heat-insulation layers being installed in a staggered manner; a outer heat-insulation layer covers a seam of a inner heat-insulation layer thereof.

2. The air-borne multilayer film building structure according to claim 1, wherein the outer heat-insulation layer of the adjacent two heat-insulation layers is fixed on the inner heat-insulation layer thereof, and the innermost heat-insulation layer is fixed on the outer wall of the independent film.

3. The air-borne multilayer film building structure according to claim 1, wherein the heat-insulation structure further comprises a plastic film, wherein a innermost heat-insulation layer is attached to the plastic film.

4. The air-borne multilayer film building structure according to claim 1, wherein a surface of the independent film, which faces the heat-insulation structure is a continuous smooth surface.

5. An air-borne multilayer film building structure, comprising an independent film, a heat-insulation structure covering the independent film, and an airbag cover covering the heat-insulation structure, wherein the airbag cover is formed by splicing a plurality of sub-airbags; each sub-airbag comprises an inner layer film facing the independent film and a surface layer film arranged on an outer side of the inner layer film at intervals; two ends of each of the inner layer film and the surface layer film are fixedly welded, wherein the heat-insulation structure is arranged on an outer wall of the independent film, wherein a center line of the heat-insulation structure is aligned with a center line of the independent film; an installing area is formed in the center of the heat-insulation structure and faces one surface of the independent film; the installing area is fixedly connected with the center of the independent film.

6. The air-borne multilayer film building structure according to claim 5, wherein a extension parts on a edges of each surface layer film are welded together by a connector.

7. The air-borne multilayer film building structure according to claim 5, wherein, a fixing net covers the airbag cover, and the lower end of the fixing net is fixed on the ground.

8. The air-borne multilayer film building structure according to claim 5, wherein a lower ends of the airbag cover and the independent film are fixed on the ground; an inflation manifold and an exhaust manifold are connected to the airbag cover; airbag inflation equipment is connected to the inflation manifold; each sub-airbag is equipped with an inflation branch pipe and an exhaust branch pipe, wherein each inflation branch pipe is connected to the inflation manifold; an inflation check valve is arranged on each inflation branch pipe; the exhaust branch pipe is connected to the exhaust manifold; an exhaust electromagnetic valve is arranged on each exhaust branch pipe; and independent film inflation equipment is connected to the independent film and blows air to the independent film through at least one inflation pipe that extends into the independent film.

9. An air-borne multilayer film building structure, comprising an independent film, a heat-insulation structure covering the independent film, and an airbag cover covering the heat-insulation structure, wherein the airbag cover is formed by splicing a plurality of sub-airbags; each sub-airbag comprises an inner layer film facing the independent film and a surface layer film arranged on an outer side of the inner layer film at intervals; two ends of each of the inner layer film and the surface layer film are fixedly welded, wherein the heat-insulation structure is arranged on an outer wall of the independent film, wherein an extension part is respectively arranged on the edges of the surface layer film of each sub-airbag, and the extension parts of every two adjacent airbags are spliced and fixed respectively;

wherein the extension parts on the edges of each surface layer film are welded together by a heat sealing machine; and wherein the connector is a pair of splints and screws passing through the pair of splints; the extension parts on the edges of the surface layer film of each sub-airbag are stacked vertically and then sandwiched between the pair of splints, and then fixed by passing the screws through the splints.

* * * * *